US005533839A

United States Patent [19]

Shimada

[11] Patent Number: 5,533,839

[45] Date of Patent: Jul. 9, 1996

[54] WALL SURFACE STRUCTURE OF REINFORCED EARTH STRUCTURE

[75] Inventor: Shunsuke Shimada, Tokyo, Japan

[73] Assignee: Kyokado Engineering Co., Ltd., Tokyo, Japan

[21] Appl. No.: 332,358

[22] Filed: Oct. 31, 1994

[30] Foreign Application Priority Data

Feb. 17, 1994 [JP] Japan ..... 6-020099

[51] Int. Cl.[6] ..... E02D 29/02

[52] U.S. Cl. ..... 405/284; 405/286

[58] Field of Search ..... 405/284, 285, 405/286; 52/610

[56] References Cited

U.S. PATENT DOCUMENTS

| | | | |
|---|---|---|---|
| 4,189,891 | 2/1980 | Johnson et al. | 405/284 X |
| 4,407,611 | 10/1983 | Murray et al. | 405/284 |
| 5,251,993 | 10/1993 | Sigourney | 405/284 X |
| 5,259,704 | 11/1993 | Orgorchock | 405/286 X |
| 5,425,600 | 6/1995 | Gordon | 405/286 X |

FOREIGN PATENT DOCUMENTS

| | | | |
|---|---|---|---|
| 0047610A1 | 3/1982 | European Pat. Off. | E02D 29/02 |
| 1485004 | 9/1977 | United Kingdom | E02D 17/18 |
| 2014222 | 8/1979 | United Kingdom | E02B 3/14 |
| 2100325A | 12/1982 | United Kingdom | E02B 3/14 |

*Primary Examiner*—William P. Neuder
*Attorney, Agent, or Firm*—James H. Tilberry

[57] ABSTRACT

A revetment comprised of nesting, interlocking, building blocks and means to adjust each block between backfilling operations. Identical T-shaped building blocks nest vertically and horizontally, and locking pins which interlock the opposite sides of the T-caps of the blocks hold the blocks in place. Channel-shaped brackets are secured to the back faces of the blocks and adjustable anchor members are secured to the channel-shaped brackets. Adjusting the length of each anchor member alters inclination to the vertical of each block as required. After proper alignment of the blocks by anchor member adjustment, the anchor members are embedded and secured in place by backfill, which is then compacted, such as by rolling or by other state-of-the-art means.

7 Claims, 9 Drawing Sheets

WALL SURFACE STRUCTURE OF REINFORCED EARTH STRUCTURE

BACKGROUND OF INVENTION

1. Field of Invention

The field of invention relates to the art of building revetments for retaining earth embankments.

2. Description of Related Art

As shown in prior art FIG. 14, prior art revetments comprise rectangular concrete blocks 20 in which the back surfaces 22 have embedded therein metal connector plates 24 to which are attached anchor means, such as metal straps 26, embedded in compacted backfill 28. The concrete building blocks are rigid, while the backfill 28 is of granular substance, which is easily compressed at the time of rolling compaction. Therefore, connector plates 24 and anchor straps 26 secured thereto by fastening means 30 may be deformed when the backfill 28 is compacted. Deformation increases with inferior backfill, which is more compressible than better grades of backfill. Furthermore, the stress placed on anchor straps 26 due to backfill compaction and settling over a period of time may cause the anchor straps 26 to separate from plates 24, and thus fail as wall stabilizing means.

The present invention provides solutions to these problems of the prior art devices.

SUMMARY OF THE INVENTION

The inventive revetment is comprised of a plurality of like precast blocks, made of concrete or other cementitious material, which are stacked together to form nesting and interlocking horizontal rows and vertical columns. In the preferred embodiment, each block comprises a rectangular base portion and a narrower rectangular upper portion centered on the base portion to expose a top surface of the base portion on each side of the upper portion to define an inverted T-shaped block. Although the inverted T-shaped block is preferred, it is to be understood that the invention also contemplates the use of the inventive blocks in normal upstanding position, wherein the revetment produced is an 180° inversion of the revetment shown in FIG. 1, and the inventive concrete block shown in FIG. 3. Vertically upstanding interlocking pins are placed in precast holes in the top surfaces of the base portions, which are concentrically aligned with matching holes precast in the bottom surfaces of the lower portions. With this configuration, like blocks nest together and are securely interlocked by the interlocking pins received in vertically aligned and abutting precast holes in nesting upper and lower adjacent blocks.

U-shaped brackets cast in the back face of each block, to project horizontally therefrom, provide horizontal spaces between the brackets and the back faces of the blocks. The threaded end of an anchor member is inserted in a vertical slot formed in the web portion of each bracket and secured therein by a large load-bearing washer plate to overlay the slot and a nut to secure the washer on the threaded end of the anchor member. The resulting connection between the bracket and the anchor member is in effect a lost motion coupling wherein the slot permits the anchor member to move up or down adjacent the bracket without dangerously stressing the connection between the bracket and the anchor member.

OBJECTS OF THE INVENTION

An object of the present invention is to provide a revetment building block of novel configuration which easily nests and interlocks with like building blocks.

Another object of the invention is to provide a revetment in which the building blocks are secured to anchor means by extremely simple and compact connection fittings.

Another object of the invention is to provide a revetment building block which is resistant to anchor deformation and ultimate destruction caused by backfill compaction and settling.

Another object of the invention is to provide novel connection means for a revetment which facilitate adjustment of the revetment during erection.

The foregoing and other objects, features, and advantages of the invention will become apparent from the detailed description set forth hereinafter when considered in conjunction with the accompanying drawings.

DESCRIPTION OF PREFERRED EMBODIMENTS OF THE INVENTION

Embodiment 1

Figure 1:
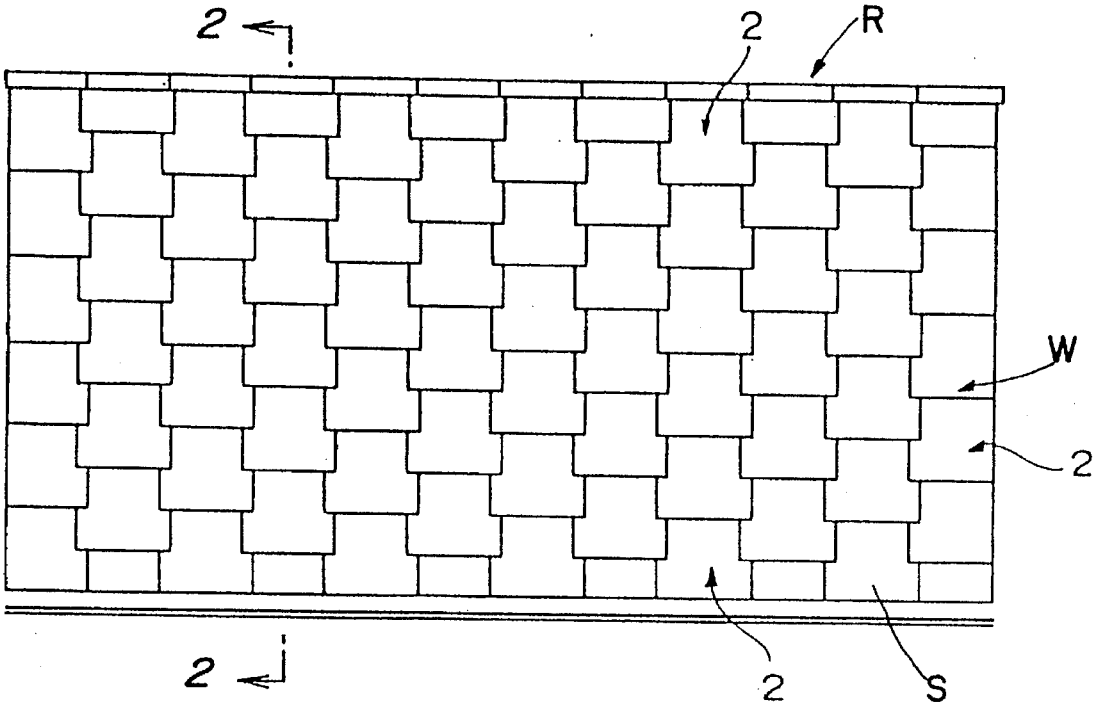
FIG. 1 is a front elevational view of a revetment structure comprised of building blocks in accordance with a preferred embodiment of the present invention.
Figure 2:
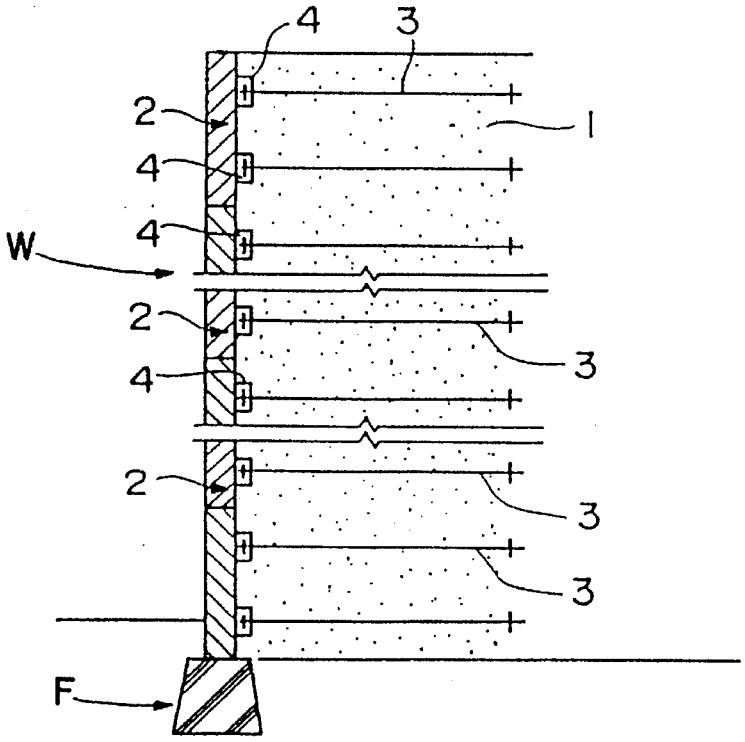
FIG. 2 is a sectional elevational view of the revetment of FIG. 1 taken along the line 2—2 of FIG. 1.

FIG. 1 shows a revetment R in accordance with a preferred embodiment of the present invention. In the figures, reference numeral 1 designates backfill banked up to a predetermined height and thoroughly compacted by rolling. Building blocks 2 nest and interlock in horizontal rows and vertical columns to form a wall W nesting on a foundation F. Anchor members 3, FIG. 2, are embedded in the backfill 1 to prevent movement, settling, and/or erosion of backfilled earth during erection of the wall W and for permanently holding the backfilled earth 1 and wall W in place following erection of the revetment R.

Figure 3:
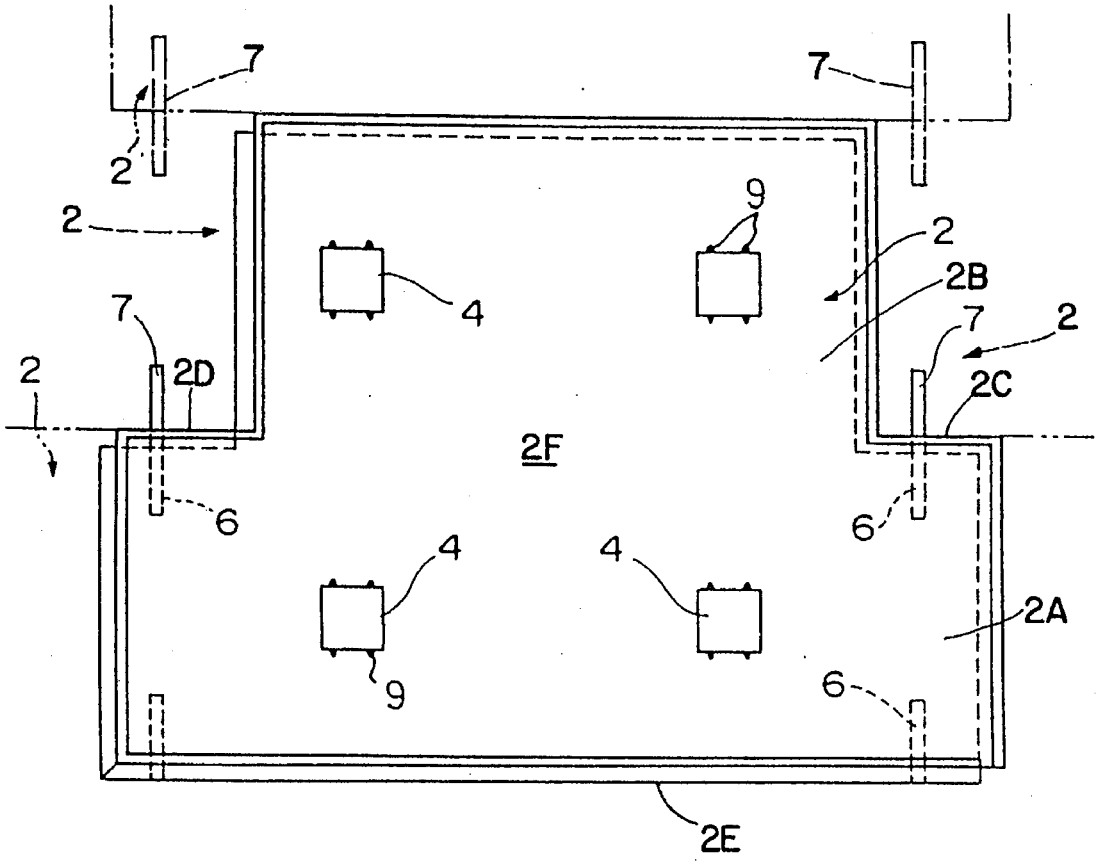
FIG. 3 is a front elevational view of the inventive building block such as shown in FIGS. 1 and 2.
Figure 4:
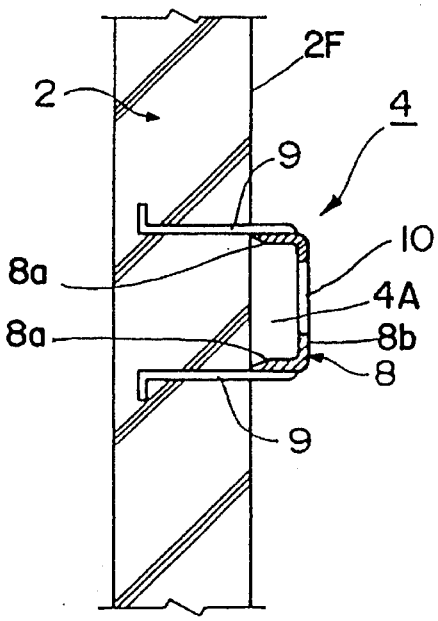
FIG. 4 is a fragmentary elevational view, partially in section, of a building block in accordance with a preferred embodiment of the invention.

FIGS. 3 through 7 illustrate a preferred embodiment of the inventive means for securing the precast building blocks to anchor members 3. As shown in FIG. 3, each precast concrete block 2 is shaped as an inverted T. As shown in FIG. 3, the building block 2 in its inverted mode comprises a rectangular base portion 2A and a narrower rectangular upper portion 2B centered on the base portion to expose top surfaces 2C and 2D of the base portion on opposite sides of the upper portion 2B. The top surfaces 2C and 2D and bottom surfaces 2E of the base portion 2A have vertical holes 6 cast therein, aligned to receive locking pins 7 of nesting portions 2A of adjacent building blocks 2. This inverted T-shaped configuration enables adjacent blocks 2 to nest together and to be secured together by the locking pins 7.

Figure 5:
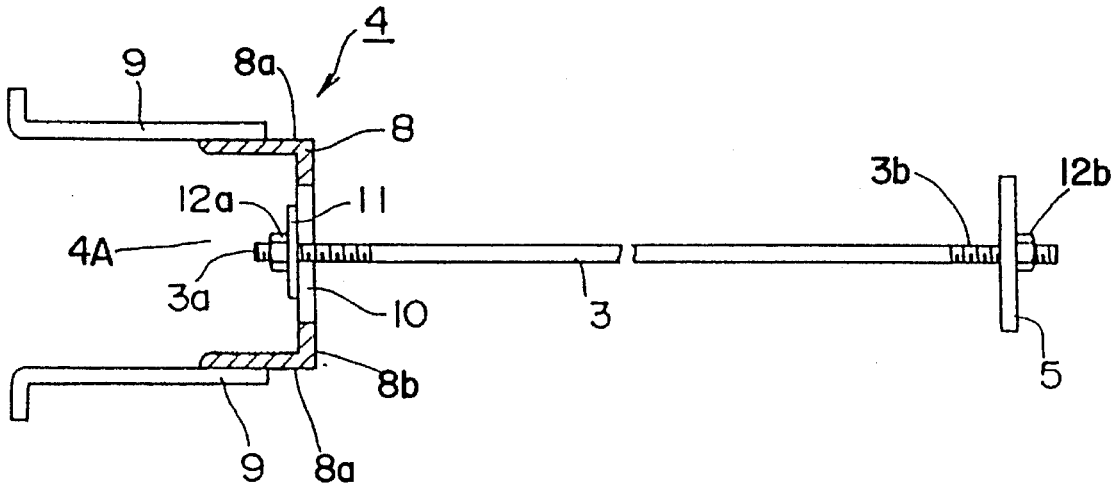
FIG. 5 is an elevational view, partially in section, of bracket and anchor means for securing building blocks to embanked backfill in accordance with a preferred embodiment of the invention.

As best shown in FIG. 5, U-shaped brackets 4 include L-shaped rods 9 which are cast in the back faces 2F of each block 2, and which are welded to the horizontal flanges 8*a* of channel-shaped members 8. Horizontal flanges 8*a* project therefrom to provide spaces 4A between the vertical web ends 8*b* of the channel-shaped members 8 and the back faces 2F of the blocks 2. Vertical slots 10 are formed in each web end 8*b* to receive the threaded end 3*a* of an anchor member 3, secured therein by a large load-bearing washer plate 11 to overlay the slot 10, and a threaded nut 12*a* to secure the washer plate 11 on the threaded end 3*a* of anchor member 3. The resulting connection between channel-shaped member 8 and anchor member 3 is in effect a lost motion coupling wherein the slot 10 of web 8*b* permits the anchor member 3 to move up or down adjacent the channel-shaped member 8 without dangerously stressing the connection between the bracket 4 and the anchor member 3. The opposite end 3*b* of anchor member 3 is also threaded to receive thereon an anchor plate 5, which is held in place by a threaded nut 12*b*. The anchor plate 5 provides resistance to horizontal slipping or shifting movement of anchor member 3. By tightening or loosening nuts 12*a* and/or 12*b*, anchor member 3 may be correctly tensioned to hold the wall W in proper vertical alignment during erection as well as after erection is completed.

Preferably the web 8*b* is sufficiently shortened so as to increase resistance to deformation against the large tensile forces acting on it. However, both the horizontal flanges 8*a* and the webs 8*b* must be properly dimensioned to provide an access space 4A sufficiently large to conveniently insert a tool for placing and threadedly engaging nut 12*a* on the threaded end 3*a* of anchor member 3.

The above described lost motion provided between channel member 8 and anchor member 3 permits anchor member 3 to yield to downward pressure due to compaction or settling of the backfilled earth 1, thereby avoiding destructive stress on web 8*a* and threaded end 3*a*. Since end 3*a* slides downwardly within slot 10 of web 8*a*, not only is stress between web 8*a* and threaded end 3*a* reduced, but stress on, and deformation of, wall W is likewise reduced.

Figure 7:
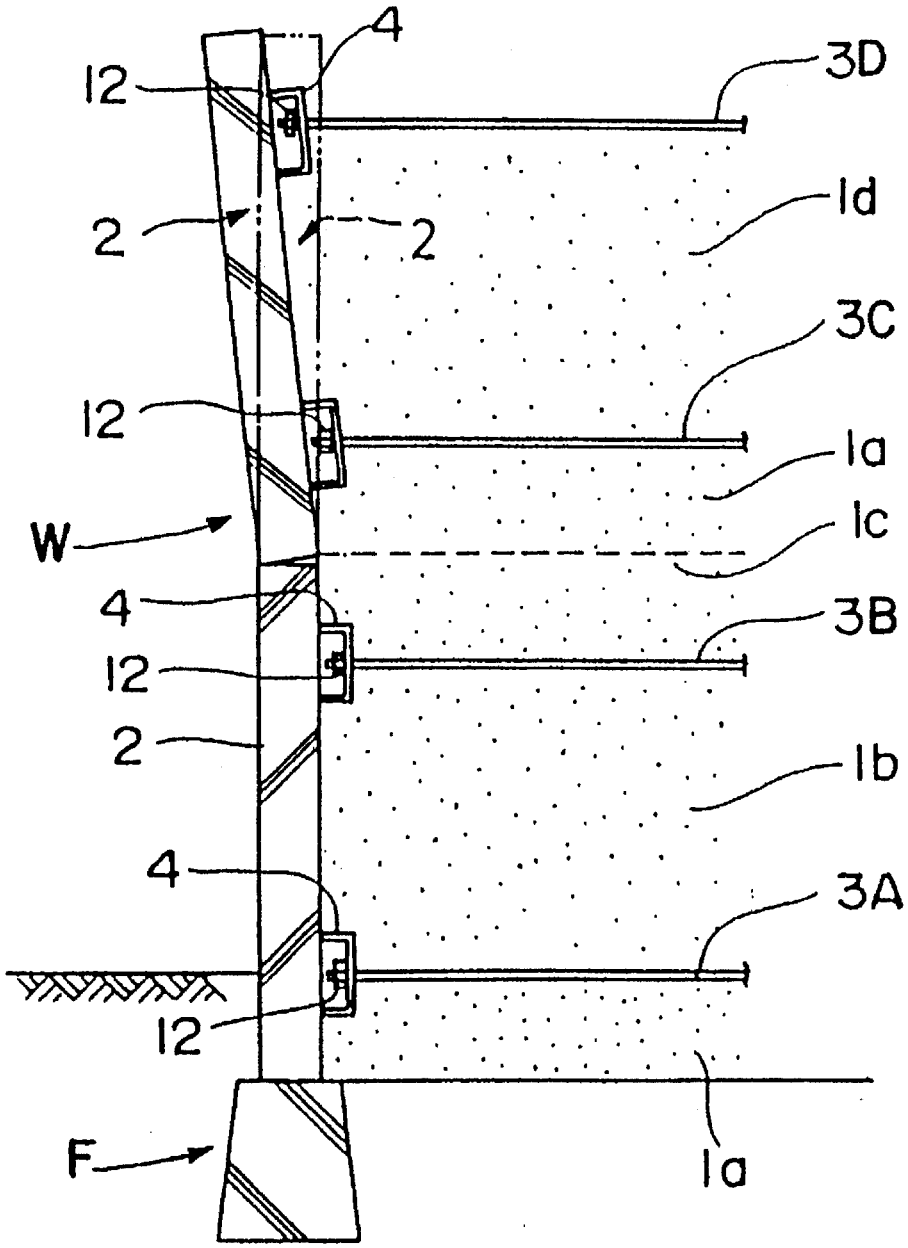
FIG. 7 is a fragmentary elevational view in section of a preferred embodiment of the invention showing the inventive wall in the process of erection.

Referring to FIG. 7, in construction of wall W, a first horizontal row of building blocks 2 is set in place on a concrete footer and a first layer of backfill is deposited and compacted. As shown in FIG. 1, a special starter block of concrete S is set between each pair of blocks 2. Thereafter, only building blocks 2 are used to build subsequent horizontal rows of wall W. An anchor member 3 is then placed on the compacted backfill layer 1 and connected to brackets 4, as previously described.

In the case of prior art revetment construction, when there is no means for adjusting the relative position between the anchor rods and the wall building blocks, the wall can become inclined outwardly, such as indicated by the upper row of concrete building blocks shown by solid lines in FIG. 7, due to lateral pressure of a deposit of backfill at the time of rolling compaction. However, in the wall constructed according to the present invention, vertically positioned building blocks 2, as indicated by broken lines in FIG. 7, can also be inclined inwardly by appropriate adjustment of the anchor member ends 3*a*, and a layer of backfill is then deposited behind the top row of blocks 2 and compacted. The top row of building blocks 2 is then adjusted to a vertical position, and the small space created thereby is filled and packed with earth or other backfill. This method of revetment construction, made possible with the inventive lost motion couplings of brackets 4 and anchor members 3, enables the construction of a wall W which is vertical and behind which the backfill is fully compacted without unduly stressing the couplings.

Figure 6:
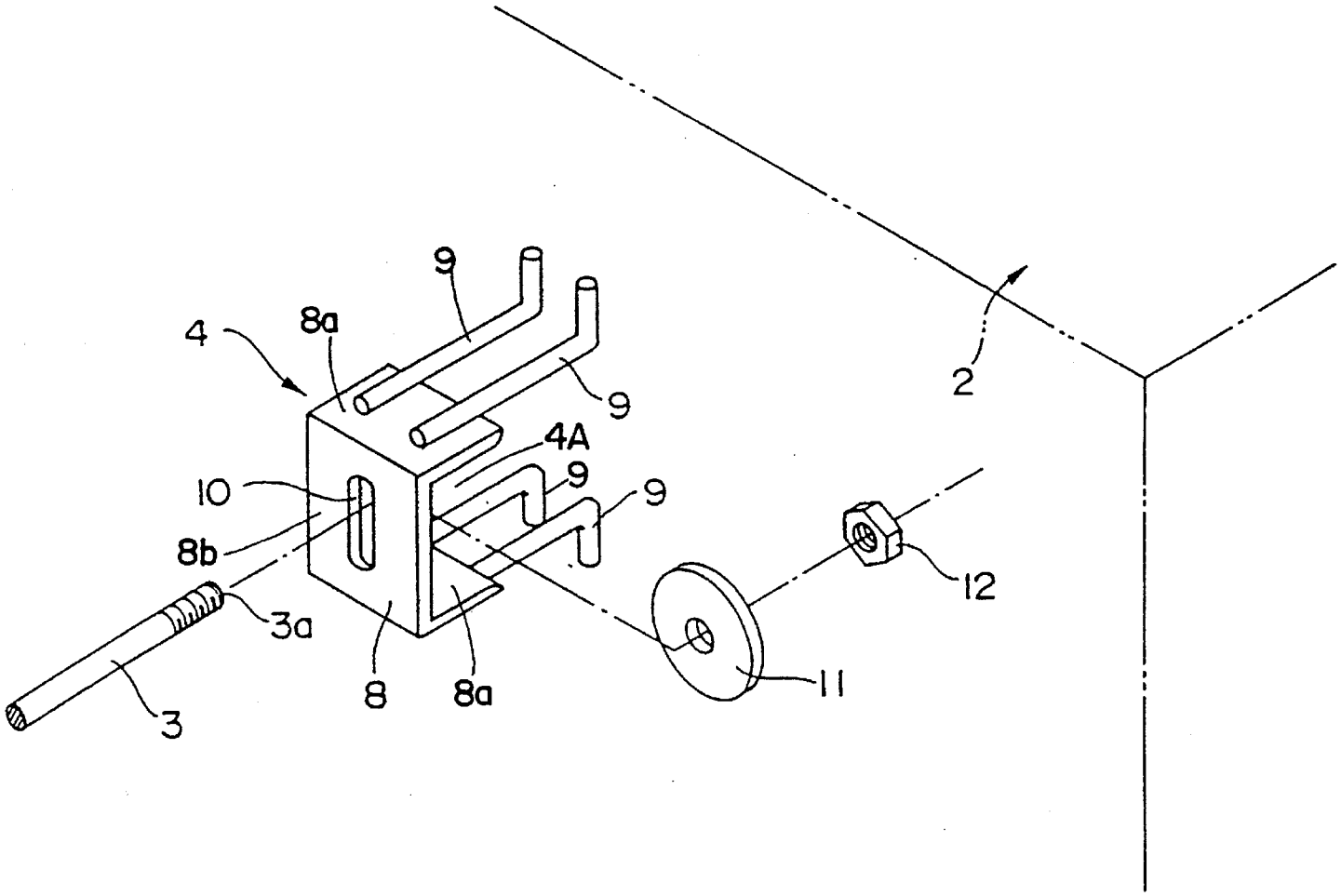
FIG. 6 is an exploded perspective view of the fitting shown in FIG. 5.

Referring to FIGS. 5 and 6, the end 3*a* of the anchor member 3 is inserted into the slot 10 of the bracket 4, and the load dispersion washer plate 11 is placed over the inserted portion of anchor member end 3*a*. Nut 12 is then threaded onto the inserted portion 3*a* to secure a building block 2 to an anchor member 3 and is properly tightened to adjust the erection of building block 2. The building block 2 can be easily adjusted by inserting a spanner wrench into the space 4A enclosed by bracket 4, and by then properly turning nut 12 to vary the threaded depth of nut 12 on threaded end 3*a* of anchor member 3. When the end 3*a* is fixed in slot 10 of bracket 4, a layer of backfill is deposited over the anchor member 3. Wall W is erected by alternately setting up a plurality of building blocks 2 and anchor members 3 and then backfilling and compacting the backfill 1.

Applicant conducted a strength test of the connection between bracket 4 and an anchor member 3, in this case a rod having a diameter of 19 mm, by tensioning the anchor rod with a jack. The channel member 8 of the bracket was almost unchanged after application of a tensile force up to 6 tons. When the tensile force was over 6 tons, but less than 14 tons, the web 8*b* of the channel member 8 was deformed. When the tensile force exceeded 14 tons, the L-shaped rods 9 pulled out from the wall surface 2F of the building blocks 2. Therefore, it is reasonably concluded that each bracket 4 has sufficient strength to resist a load of approximately 6 tons in tension.

Assuming that the dimensions of the concrete building block are approximately 1.5 m×1.5 m=2.25 $m^2$, the height of the backfill 1 is 15 m, the unit weight of the backfill is 1.8 $t/m^2$, and the coefficient of earth pressure K is set to be equal to 0.33, the earth pressure strength P at the lowermost portion results in $$P=0.33\times1.8\times1.5=8 \text{ tons.}$$

If four bracket fittings 4 are mounted on each building block 2, the load P applied on one bracket fitting 4 results in $$P=8.9\times2.25/4=5 \text{ tons.}$$

Thus, if four bracket fittings 4 are mounted on each concrete building block 2 having a vertical area of 2.25 $m^2$, a backfill having the height of 15 m can be supported without any deformation of the bracket fittings 4.

Embodiment 2

Figure 8:
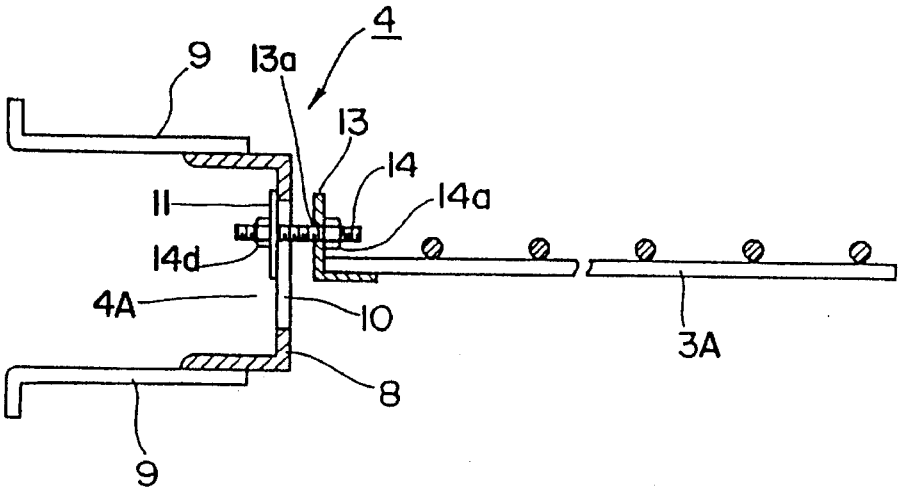
FIG. 8 is an elevational view, partially in section, showing a modification of the invention disclosed in FIG. 5.
Figure 9:
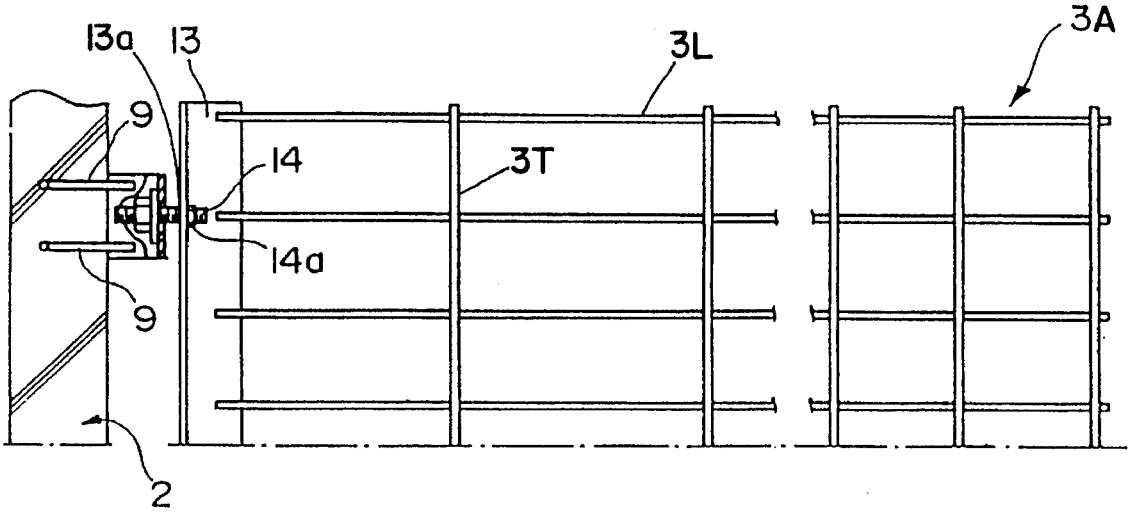
FIG. 9 is a plan view, partially in section, of the invention shown in FIG. 8.

FIGS. 8 and 9 show another embodiment of the connection portion between the building block 2 and an anchor member 3A. The anchor member 3A in this embodiment comprises a reinforcing grid of longitudinal rods 3L and transverse rods 3T arranged in a lattice and contact portions of the reinforcement members 3L and 3T are welded integrally to each other.

An angle iron 13 is welded to the left ends of longitudinal members 3L, as shown in FIG. 9, and is connected to the channel member 8 of the bracket by means of a threaded stud bolt 14 with one end inserted into the slot 10 of the channel member 8 and the other end is inserted in a bolt hole 13*a* of the angle iron 13. Washer 11 and nuts 14*a* complete the connection. The interval between the bracket fitting 4 and the angle iron 13 is adjusted by properly tightening nuts 14*a*, which adjust the gradient of the concrete block 2.

According to the embodiment described above, the nuts 14*a* outside of space 4A can be tightened more easily than the nuts 14*a* inside space 4A of channel 8, thereby making it easier to adjust the erection of the wall. Further, since there is no limit to the length of stud bolt 14, it is possible to adjust large gradients of the blocks 2.

Embodiment 3

Figure 10:
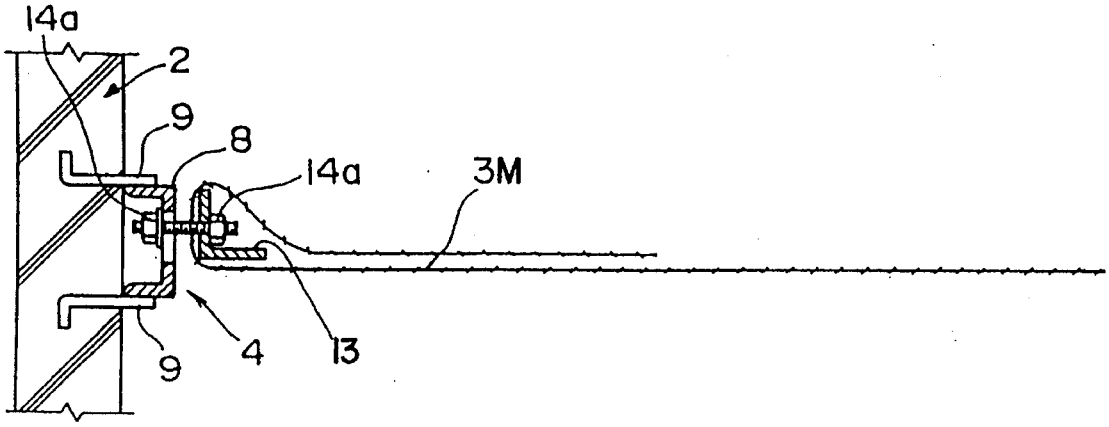
FIG. 10 is a side elevational view, partially in section, showing a modification of the invention shown in FIGS. 8 and 9.
Figure 11:
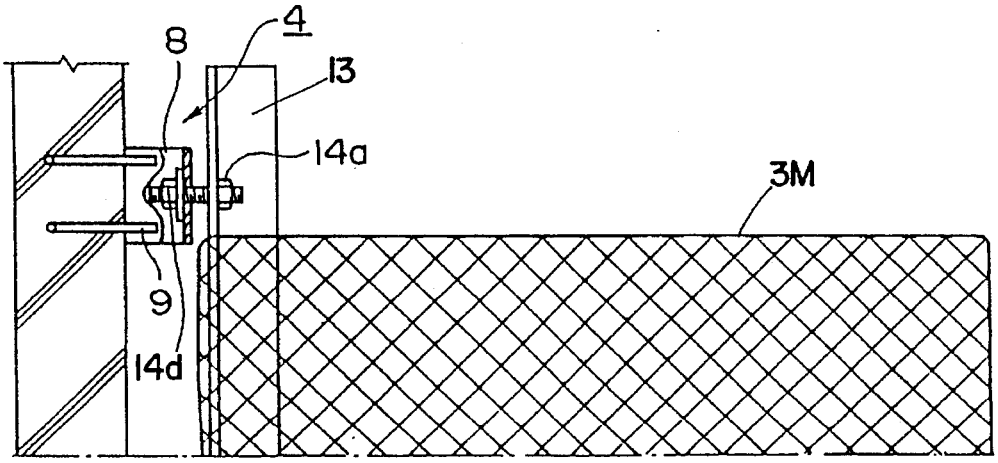
FIG. 11 is a plan view, partially in section, of the invention shown in FIG. 10.

The embodiment of FIGS. 10 and 11 is similar to the embodiment of FIGS. 8 and 9, except that a lightweight orthogonal mesh 3M is employed in lieu of the welded anchor rod members 3L and 3T of FIGS. 8 and 9. Mesh 3M is more flexible than anchor rod members 3L and 3T, and therefore can be secured to angle iron 13 by wrapping the mesh 3M around angle iron 13 and doubling back the free end to overlay or underlay the main portion of the mesh. The mesh 3M is positioned between a pair of horizontally spaced apart brackets 4, whereby ready access can be had to adjusting nuts 14*a* before they are covered with backfill.

Embodiment 4

Figure 12:
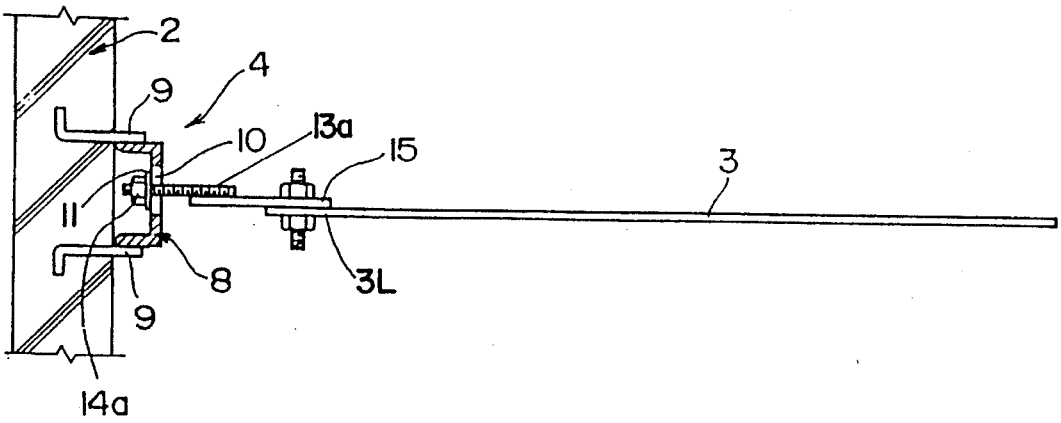
FIG. 12 is a side elevational view, partially in section, of another modification of the invention shown in FIG. 5.
Figure 13:
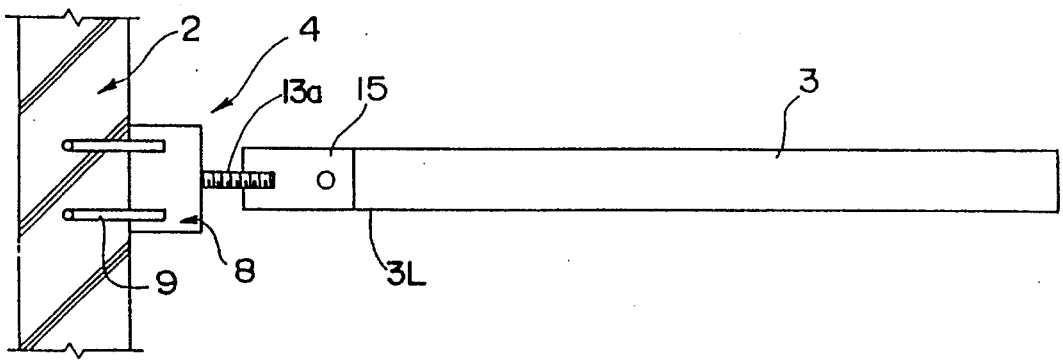
FIG. 13 is a plan view of the invention shown in FIG. 12.
Figure 14:
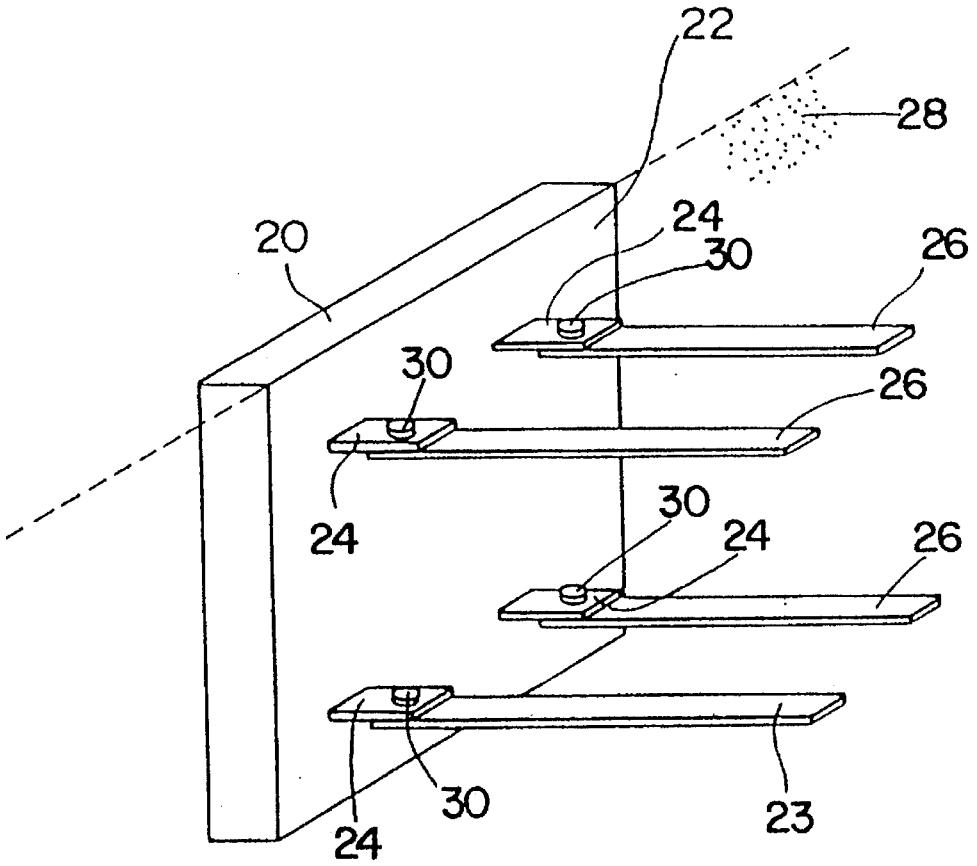
(PRIOR ART) Fig. 14
FIG. 14 is a perspective view of a prior art revetment showing a prior art building block and fittings for anchoring the building block to embanked backfill.

FIGS. 12 and 13 show a still further embodiment of connecting means between bracket 4 and anchor member 3. In this embodiment, anchor member 3 is a metal strap. End 3L is bolted to a short plate 15, which, in turn, is welded to a threaded stud bolt 13*a*, secured to bracket 4 with a load bearing washer 11 and a fixing nut 14*a*, such as previously described with respect to the first three embodiments.

Industrial Utilization

The subject invention provides a novel combination of nesting, interlocking building blocks and means for connecting anchor members to the blocks so as to reduce stress between the building block connecting bracket members and the anchor members. This combination also enables individual blocks to be separately adjusted during erection of the revetment so that the wall may be kept in proper alignment during all stages of its erection.

It will occur to those skilled in the art, upon reading the foregoing description of the preferred embodiments of the invention, taken in conjunction with a study of the drawings, that certain modifications may be made to the invention without departing from the intent or scope of the invention. It is intended, therefore, that the invention be construed and limited only by the appended claims.

I claim:

1. An improvement in revetments comprising identical interlocking building blocks aligned in horizontal rows and vertical columns, each building block having a front face and a back face, and means to secure adjustable anchor means to each said back face of each said building block, wherein said means to secure said adjustable anchor means to the back face of said building block comprises: a U-shaped bracket having leg portions and a connecting web portion, said leg portions being integrally secured to said back face of said building block, and said web portion having formed therein a vertical slot; said leg portions, said web portion, and said back face forming an enclosure having open ends sufficient to permit a tool therein; said adjustable anchor means having a first threaded end which is received in and which passes through said vertical slot; a load distribution washer plate received over said first threaded end; and a first threaded nut threaded over said first threaded end to complete a lost motion coupling between said U-shaped bracket and said adjustable anchor means.

2. The improvement in revetments of claim 1 wherein said identical interlocking building blocks are vertically aligned, T-shaped, and dimensioned to nest both horizontally and vertically with adjacent building blocks.

3. The improvement in revetments of claim 2, wherein each said identical interlocking T-shaped building block comprises a vertical rectangular body having vertical side walls and a horizontal rectangular T-cap having end portions extending laterally equally beyond respective side walls of said vertical body, and means to interlock said end portions of said adjacent T-caps.

4. The improvement in revetments of claim 3, wherein each said T-cap end portion has cast therein a vertical cylindrical hole adapted to receive therein a pin and a portion thereof to project therefrom to be received in a like concentric hole in an adjacent T-cap.

5. The improvement in revetments of claim 1, including a second threaded end of said adjustable anchor means; an anchor plate having an aperture; said second threaded end projecting through said aperture; and a second threaded nut threaded onto said second threaded end of said adjustable anchor means, whereby said second threaded nut prevents said anchor plate from escaping said second threaded end of said adjustable anchor means.

6. The improvement in revetments of claim 1, including a cross member, said first threaded end of said adjustable anchor means comprising a threaded stud having a first end secured to said U-shaped bracket and a second end secured to said cross member, a plurality of parallel spaced-apart anchor rods having first ends secured to said cross member, and a plurality of parallel, spaced-apart cross rods, normal to and secured to said anchor rods.

7. The improvement in revetments of claim 1, including a cross member, said first threaded end of said adjustable anchor means comprising: a first threaded stud bolt; a second threaded stud bolt; first and second horizontally spaced-apart U-shaped brackets secured to said back face of said building block; said first threaded stud bolt being secured to said first U-shaped bracket; said second threaded stud bolt being secured to said second U-shaped bracket; and flexible rectangular mesh having a free end and an anchored end, said free end being wrapped around said cross member to lap the portion of said rectangular mesh between said cross member and said anchored end.

* * * * *